US008690399B2

(12) United States Patent
Ladstätter

(10) Patent No.: US 8,690,399 B2
(45) Date of Patent: Apr. 8, 2014

(54) LUMINAIRE HAVING A PIVOTABLE LED

(75) Inventor: Gerald Ladstätter, Klaus (AT)

(73) Assignee: Zumtobel Lighting GmbH, Dornbirn (AT)

( * ) Notice: Subject to any disclaimer, the term of this patent is extended or adjusted under 35 U.S.C. 154(b) by 0 days.

(21) Appl. No.: 13/583,854

(22) PCT Filed: Apr. 6, 2011

(86) PCT No.: PCT/EP2011/055333
§ 371 (c)(1), (2), (4) Date: Sep. 10, 2012

(87) PCT Pub. No.: WO2011/124600
PCT Pub. Date: Oct. 13, 2011

(65) Prior Publication Data

US 2013/0010458 A1 Jan. 10, 2013

(30) Foreign Application Priority Data

Apr. 9, 2010 (DE) ..... 20 2010 004 776 U

(51) Int. Cl.

| | |
|---|---|
| ***F21V 14/02*** | (2006.01) |
| ***F21V 21/28*** | (2006.01) |
| ***F21V 19/02*** | (2006.01) |
| *F21V 29/00* | (2006.01) |
| *F21S 8/02* | (2006.01) |

(52) U.S. Cl.
CPC ..... *F21V 21/28* (2013.01); *F21V 19/02* (2013.01); *F21V 14/02* (2013.01); *F21V 29/00* (2013.01); *F21S 8/02* (2013.01)
USPC ..... 362/421; 362/287; 362/269; 362/275; 362/427; 362/372

(58) Field of Classification Search
USPC ..... 362/147–150, 269–270, 275, 282, 284, 362/285–289, 421, 373, 418, 800
See application file for complete search history.

(56) References Cited

U.S. PATENT DOCUMENTS 1,539,238 A * 5/1925 Browne ..... 362/287
4,088,396 A * 5/1978 Edelstein ..... 359/822

(Continued)

FOREIGN PATENT DOCUMENTS

DE 20 2008 005814 U1 8/2008
DE 10 2008 007 647 A1 8/2009

OTHER PUBLICATIONS

International Search Report issued in connection with the corresponding International Application No. PCT/EP2011/055333 on Jul. 6, 2011.

(Continued)

*Primary Examiner* — Anabel M Ton
*Assistant Examiner* — Kenny C Sokolowski
(74) *Attorney, Agent, or Firm* — The H.T. Than Law Group

(57) ABSTRACT

In a luminaire, comprising a light source (2) having at least one LED and a heat sink (4) for cooling the LED, the light source (2) is arranged pivotably with respect to the heat sink (4), wherein three lever arms (6, 8, 10) that act on the light source (2) are provided and the luminaire is designed such that the light source (2) is pressed against the heat sink (4) by the three lever arms (6, 8, 10). Moreover, a spring element (12), which acts on a first (6) of the three lever arms (6, 8, 10), and an adjusting means (14) for adjusting a second (8) of the three lever arms (6, 8, 10) are provided.

14 Claims, 2 Drawing Sheets

(56) References Cited

U.S. PATENT DOCUMENTS

| | | | | |
|---|---|---|---|---|
| 4,574,334 | A * | 3/1986 | Igura | 362/515 |
| 4,751,627 | A * | 6/1988 | Usher | 362/421 |
| 4,845,997 | A * | 7/1989 | Radin et al. | 73/831 |
| 5,138,496 | A * | 8/1992 | Pong | 359/822 |
| 6,614,601 | B2 * | 9/2003 | Dallakian | 359/804 |
| 7,261,442 | B2 * | 8/2007 | Chiu | 362/372 |
| 7,744,259 | B2 * | 6/2010 | Walczak et al. | 362/421 |
| 7,775,683 | B2 * | 8/2010 | Ziemkowski et al. | 362/259 |
| 8,016,438 | B2 * | 9/2011 | Meyer et al. | 359/872 |
| 8,029,161 | B2 * | 10/2011 | Ono | 362/269 |
| 8,152,334 | B2 * | 4/2012 | Krogman | 362/249.02 |
| 2007/0025105 | A1 | 2/2007 | Takashi et al. | |
| 2010/0103685 | A1 * | 4/2010 | Austin | 362/366 |

OTHER PUBLICATIONS

Translated Abstract of DE102008007647 (A1)—Aug. 13, 2009 to Ladstaetter et al.

* cited by examiner

LUMINAIRE HAVING A PIVOTABLE LED

BACKGROUND OF THE INVENTION

The invention relates to a luminaire having a light source, which has at least one LED (light-emitting diode), and also having a heat sink to cool the LED, in which the light source is pivotably arranged with respect to the heat sink.

Such a luminaire is known from DE 10 2008 007 647 A1. In the case of this luminaire the LED can be aligned differently with respect to the heat sink by pivoting; in this way it is possible to change the direction in which in the main light is radiated from the luminaire. In order to vary the direction of the emission of light in this way, manual adjustment of the LED is required. Manual adjustment can entail problems, for example if very small and precise changes in the main direction of radiation are desired or if the luminaire is arranged outside a user's usual manual reach for operation.

SUMMARY OF THE INVENTION

The underlying object of the invention is to specify a corresponding luminaire in which the possibilities for adjusting the main direction of radiation are improved.

This object is achieved in accordance with the invention by means of the subject matter mentioned in the independent claim. Special embodiments of the invention are specified in the dependent claims.

In accordance with the invention a luminaire is provided that has a light source with at least one LED and also has a heat sink for cooling the LED, wherein the light source is pivotably arranged with respect to the heat sink. Moreover, the luminaire has three lever arms that act on the light source, wherein the luminaire is formed in such a way that the light source is pressed by means of the three lever aims against the heat sink; furthermore, the luminaire has a spring element, which acts on a first lever arm of the three lever arms, and also an adjusting means to adjust a second lever arm of the three lever arms.

By actuating the adjusting means, the light source can be pivoted in a particularly precise manner with respect to the heat sink. A particularly exact or fine setting of the direction of radiation is thus facilitated.

The light source and the heat sink are preferably connected in an articulated manner by way of a ball joint. As a result, it is made possible for the main direction of radiation of the luminaire to be adjustable basically in all possible directions. Moreover, as a result particularly good heat transmission from the LED to the heat sink is rendered possible.

The adjusting means preferably has a threaded structure, for example in the form of an adjusting screw. As a result, particularly fine adjustment is rendered possible. In this connection, furthermore, advantageously the adjusting means has, moreover, a nut which is rotatably connected to the threaded structure, the nut having an area which is in the form of a spherical segment and on which the second lever arm rests directly. This, when the light source is pivoted, renders possible particularly good support of the second lever arm on the adjusting means at all times. Moreover, the luminaire expediently has a securing element to prevent a rotation of the nut with respect to the second lever aim about a longitudinal axis of the threaded structure. This renders possible particularly reliable adjustment of the second lever arm with the aid of the adjusting means. The securing element is then preferably fixedly arranged on the nut.

The luminaire preferably has, furthermore, a further adjusting means, that is, to adjust one of or rather the third of the three lever arms. As a result, it is made possible for the LED to be able to be adjusted in all directions by the adjusting means first mentioned and the further adjusting means. The further adjusting means is then preferably formed in a similar manner to that of the adjusting means first mentioned.

The three lever arms advantageously have altogether a T-shape or anchor shape.

Furthermore, the luminaire advantageously has a supporting element, wherein the spring element is arranged so as to be supported on the supporting element, and the adjusting means is arranged so as to be supported on the supporting element. This renders possible an all in all compact structural form of the luminaire. The supporting element is preferably annular; the supporting element is advantageously arranged so that it is immovable with respect to the heat sink or is configured as part of the heat sink.

The heat sink has two, preferably just two, through-openings for the three lever arms. As a result a compact structural form is rendered possible with at the same time a comparatively large surface of the heat sink.

Furthermore, the luminaire advantageously has a motor to adjust the adjusting means. This renders possible a particularly precise and at the same time remotely controllable setting of the direction of radiation of light of the luminaire.

The luminaire is particularly suitable as a built-in ceiling luminaire.

The invention is explained in greater detail in the following with the aid of an exemplary embodiment and with reference to the drawings, in which:

DETAILED DESCRIPTION OF THE INVENTION

Figure 1:
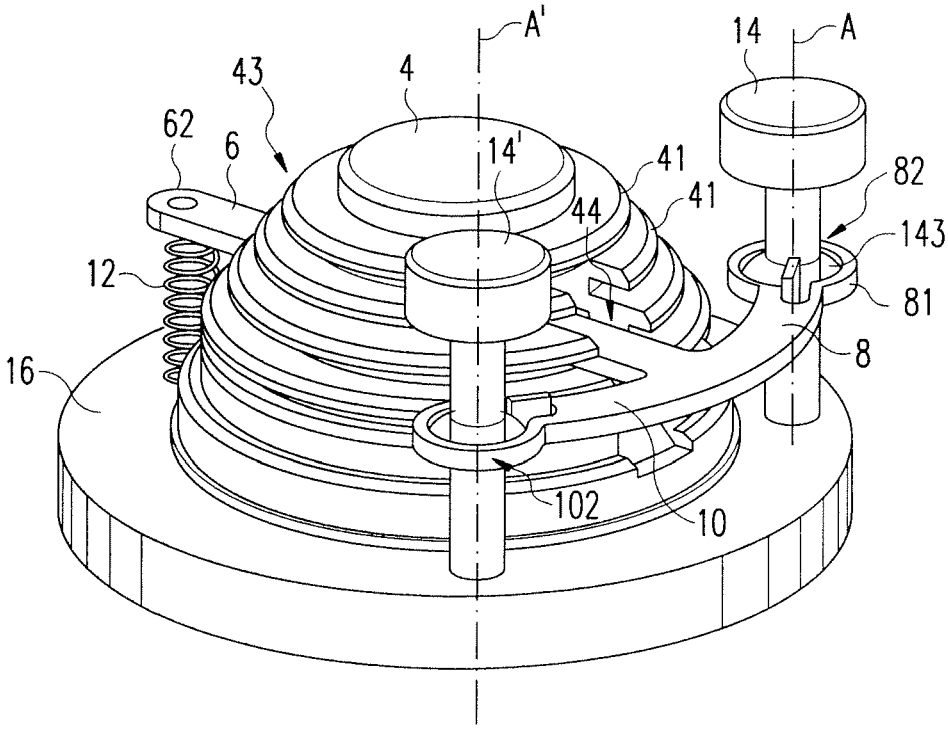
FIG. 1 shows a diagrammatic perspective sketch of a luminaire in accordance with the invention.
Figure 2:
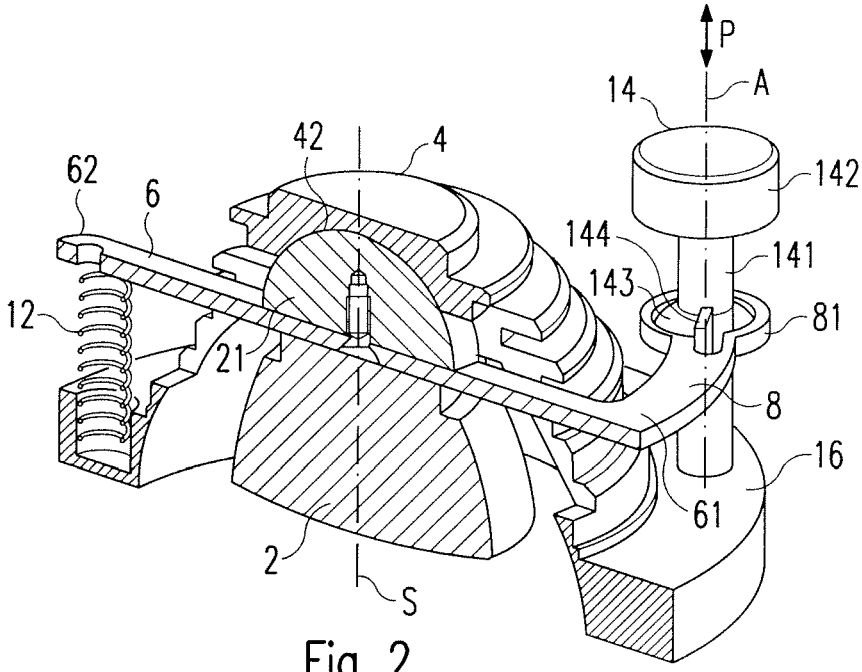
FIG. 2 shows a perspective sketch of a cross section.

FIG. 1 shows a diagrammatic view of a luminaire in accordance with the invention; FIG. 2 shows a corresponding cross section. The luminaire comprises a light source 2. The light source 2 has at least one LED, preferably a plurality of LEDs. In particular, it can be provided that the light source 2 has as an illuminant just one LED or a plurality of LEDs.

The LED can be arranged on a printed circuit board.

The light source 2 can comprise, moreover, an optical element (not expressly shown in the figures) to influence a light produced by the LED or LEDs.

Furthermore, the luminaire has a heat sink 4 which is designed to cool the LED, preferably the light source 2, during operation of the luminaire. The heat sink 4 can have a plurality of cooling ribs 41. The heat sink 4 can, furthermore, be configured in such a way that with reference to a main axis S of the heat sink 4 it surrounds the light source 2 or the LED in an annular manner, preferably, as shown by way of example in FIG. 2, in a pot-shaped manner.

The light source 2 is pivotably arranged with respect to the heat sink 4. The light source 2 and the heat sink 4 are preferably connected together in an articulated manner by way of a ball joint. As a result, it is made possible for the light source 2 to be able to be pivoted in all directions relative to the heat sink 4. The ball joint can in particular be configured in such a way that the heat sink 4 forms a joint socket 42 of the ball joint, and the light source 2 a joint head 21 that has the form of a spherical segment corresponding, in accordance with the articulated connection, to the form of the joint socket 42.

The luminaire has three lever arms 6, 8, 10, that is, a first lever arm 6, a second lever arm 8 and a third lever arm 10. The lever arms 6, 8, 10 are configured in such a way that they act on the light source 2; in particular they are configured in such a way that in the event of a movement of the lever arms 6, 8, 10 the light source 2 is pivoted with respect to the heat sink 4. In this connection, the luminaire is formed in particular in such a way that the light source 2 is pressed by the three lever arms 6, 8, 10 against the heat sink 4, that is, for example into the joint socket 42. Thus with reference to the representations of FIGS. 1 and 2 the light source 2 is pressed "upwards" against the heat sink 4 into the joint socket 41.

The three lever arms 6, 8, 10 are preferably formed in such a way that they point in three different radial directions with reference to the main axis S; for example, the configuration can be such that in each case two adjacent lever arms of the three lever arms 6, 8, 10 enclose an angle of between 100° and 140°, preferably an angle of 120°. A first end region 62 lying opposite the light source 2 can be formed on the first lever arm 6, a corresponding second end region 82 can be formed on the second lever arm 82, and a corresponding third end region 102 can be formed on the third lever arm 10.

Furthermore, the luminaire has a spring element 12 which acts on the first lever arm 6. In particular, the configuration can be such that on account of the action of the spring element 12 the light source 2 is pressed against the heat sink 4. The spring element 12 can be for example—as shown in the figures—a compression spring or a leaf spring or the like. Advantageously, the spring element 12 acts on the first end region 62.

The spring element 12 is preferably designed in such a way that the light source 2 is pressed against the heat sink 4 in a reliable manner for the duration of the whole of the expected lifetime of the luminaire. The design is preferably even such that the light source 2 rubs or fits into the joint socket 42 in the course of time.

Furthermore, the luminaire has an adjusting means 14 to adjust the second lever arm 8. In particular, the adjusting means 14 can have a threaded structure 141 (which is not expressly shown in FIGS. 1 and 2 for the sake of clarity). The threaded structure 141 can be formed in particular about a longitudinal axis A which is preferably formed so as to be oriented parallel to the main axis S.

The adjusting means 14 can have, for example, an adjusting screw with an adjusting-screw head 142 and the thread 141. The adjusting-screw head 142 is then preferably formed in such a way that it is at least also suitable for manual adjustment, that is, rotation.

In particular, the adjusting means 14 can thus be formed so as to act on the second lever arm 8 in such a way that the lever arm 8 or the second end region 82 is moved along the longitudinal axis A, that is, in accordance with the double arrow P sketched in FIG. 2. The adjusting means 14 thus preferably acts in particular on the second end region 82. In conjunction with the spring element 12 in this way the alignment of the light source 2 with respect to the heat sink 4 can be changed by adjusting the adjusting means 14.

Furthermore, the adjusting means 14 preferably has a nut 143 which is rotatably connected to the threaded structure 141, wherein the nut 143 has an area which is in the form of a spherical segment and on which the second lever arm 8 rests directly. In particular, the second lever arm 8 can have for this a ring element 81 which is formed so as to rest on the area of the nut 143 that is in the form of a spherical segment. As a result, particularly good support of the second lever arm 8 on the nut 143 is rendered possible, wherein by the spring element 12 the joint head 21 is pressed or forced against the joint socket 42 in a reliable manner and with good area contact. Moreover, by the spring element 12 the second lever arm 8 is pressed against the area of the nut 143 that is in the form of a spherical segment. The adjusting means 14 preferably has, furthermore, a securing element 144 to prevent rotation of the nut 143 with respect to the second lever aim 8 about the longitudinal axis A of the threaded structure 141; in this connection, expediently the securing element 144 is fixedly arranged on the nut 143. By means of the securing element 144 a situation can be avoided where in the event of a rotation of the adjusting means 14 to change the alignment of the light source 2 the nut 143 turns together with the threaded structure 141 and in this way the first lever arm 6 is moved in an undefined manner or not at all.

The luminaire preferably has, moreover, a further adjusting means 14' to adjust the third lever arm 10, wherein the further adjusting means 14' is preferably formed in a similar manner to that of the adjusting means 14 first mentioned.

Alternatively, a further spring element could be provided that acts on the third lever arm 10 in the way that the spring element 12 first mentioned acts on the first lever arm 6. However, the possibilities for adjustment are reduced with this alternative.

As is the case with the exemplary embodiment shown, the three lever arms 6, 8, 10 advantageously altogether have a T-shape or an anchor shape, in particular in a plane perpendicularly to the main axis S.

Furthermore, the luminaire preferably has a supporting element 16, wherein the spring element 12 is arranged so as to be supported on the supporting element 16, and the adjusting means 14 is also arranged so as to be supported on the supporting element 16. The adjusting means 14 can in this connection be rotatably mounted in the supporting element 16.

The supporting element 16 is preferably formed in an annular manner. For example, it can be formed so that it is annular about the main axis S. In particular, it can be formed so that it is immovable with respect to the heat sink 4; it can be arranged so that it is directly adjacent to the heat sink 4; it can form, for example, an edge closure of the heat sink 4 formed in a pot-shaped manner. The supporting element 16 can, however, also be formed in a space-saving manner as part of the heat sink 4.

Of course, the further adjusting means 14' can also be arranged so that it is supported on the supporting element 16, in particular in a manner similar to that of the configuration with reference to the adjusting means 14 first mentioned.

The heat sink 4 preferably has two through-openings 43, 44 for the three lever arms 6, 8, 10. In particular, this is advantageous if the heat sink 4 is formed in a pot-shaped manner around the light source 2, and the lever arms 6, 8, 10 altogether have the T-shape or anchor shape mentioned, as is the case in the exemplary embodiment shown. In particular, the configuration can be such that the second lever arm 8 and the third lever arm 10 extend from the level of the light source 2 in the first instance together or in parallel as far as a branch point 61 and diverge from the branch point 61 towards their respective end regions 62 and 82. The branch point 61 then preferably lies, with reference to the light source 2, outside the heat sink 4 and in this connection, for example, diametrically opposite the end region 62 of the first lever arm 6. Thus the two through-openings 43, 44 are quite sufficient for a movement of the lever arms 6, 8, 10 or of the light source 2 respectively relative to the heat sink 4 so that in this way a surface of the heat sink 4 that is as large as possible and thus particularly effective cooling are rendered possible.

The luminaire preferably has, furthermore, a motor (not shown in the figures) that is formed to adjust the adjusting means 14 and in this way to change the alignment of the light source 2 with respect to the heat sink 4. As a result, a basis for intelligent light-application is formed. In particular, two electric motors can be provided, wherein the longitudinal axis A of the adjusting element 14 and the corresponding longitudinal axis A' of the further adjusting element 14' form adjusting axes of the electric motors. The adjusting means 14 can, as an alternative to the above-mentioned adjusting screw, also be formed as a linear drive or the like; the same also applies of course in a corresponding manner to the further adjusting means 14'.

Particularly advantageously, the luminaire is a built-in ceiling luminaire, for example an LED spotlight.

Figure 3C:
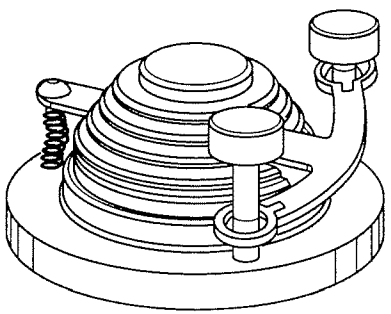
FIGS. 3*a* to 3*c* show three views of the luminaire in different positions of the light source with respect to the heat sink.
Figure 3B:
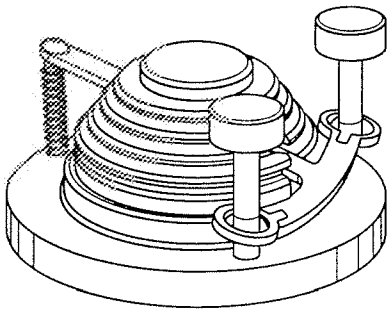
Figure 3A:
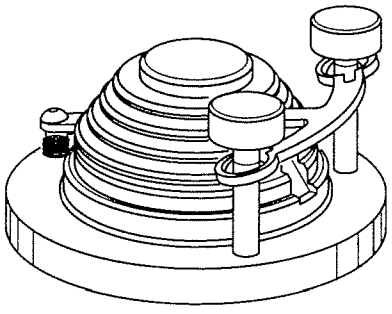

Three different positions of the light source 2 with respect to the heat sink 4 are shown in FIGS. 3*a* to 3*c* for the purposes of supplementary illustration. In FIG. 3*a* the case is shown in which the adjusting element 14 and the further adjusting element 14' are set in such a way that the second lever arm 8 and the third lever arm 10 are in each case at a maximum distance away from the supporting element 16; in FIG. 3*b* the second lever arm 8 and the third lever arm 10 are brought as close as possible to the supporting element 16; in FIG. 3*c* the second lever arm 8 is at a distance from the supporting element 16, and the third lever arm 10 is brought close to the supporting element 16.

The invention claimed is:

1. A luminaire, having a light source (2) with at least one LED, and a heat sink (4) for cooling the LED, wherein the light source (2) is pivotally arranged with respect to the heat sink (4)

characterised by three lever arms (6, 8, 10) that act on the light source (2), wherein the luminaire is formed in such a way that the light source (2) is pressed by means of the three lever arms (6, 8, 10) against the heat sink (4), wherein the three lever arms (6, 8 10) are configured in such a way that in the event of a movement of the lever arms (6, 8, 10) the light source (2) is pivoted with respect to the heat sink (4);

wherein the three lever arms (6, 8, 10) extend from an inside of the heat sink to an outside of the heat sink (4);

a spring element (12), which acts on a first lever arm (6) of the three lever arms (6, 8, 10), and an adjusting means (14) to adjust a second lever arm (8) of the three lever arms (6, 8, 10).

2. A luminaire according to claim 1, in which the light source (2) and the heat sink (4) are connected in an articulated manner by way of a ball joint.

3. A luminaire according to claim 1, in which the adjusting means (14) has a threaded structure (141).

4. A luminaire according to claim 3, in which the adjusting means (14) has, furthermore, a nut (143) which is rotatably connected to the threaded structure (141), wherein the nut (143) has an area which is in the form of a spherical segment and on which the second lever arm (8) rests directly.

5. A luminaire according to claim 4, in which the adjusting means (14) has, furthermore, a securing element (144) to prevent a rotation of the nut (143) with respect to the second lever arm (8) about a longitudinal axis (A) of the threaded structure (141), wherein the securing element (144) is preferably fixedly arranged on the nut (143).

6. A luminaire according to claim 3, wherein the threaded structure (141) comprises-an adjusting screw.

7. A luminaire according to claim 1, having, furthermore, a further adjusting means (14') to adjust a third lever aim (10) of the three lever arms (6, 8, 10), wherein the further adjusting means (14') is preferably formed in a similar manner to that of the adjusting means (14) first mentioned.

8. A luminaire according to claim 1, in which the three lever arms (6, 8, 10) altogether have a T-shape or anchor shape.

9. A luminaire according to claim 1, having, furthermore, a supporting element (16), which is annular, wherein the spring element (12) is arranged so as to be supported on the supporting element (16), and the adjusting means (14) is arranged so as to be supported on the supporting element (16).

10. A luminaire according to claim 9, in which the supporting element (16) is arranged so that it is immovable with respect to the heat sink (4) or is formed as part of the heat sink (4).

11. A luminaire according to claim 1, in which the heat sink (4) has at least two through-openings (43, 44) for the three lever aims (6, 8, 10).

12. A luminaire according to claim 1, having, furthermore, a motor to adjust the adjusting means (14).

13. A luminaire according to claim 1 in the form of a built-in ceiling luminaire.

14. A luminaire having a light source (2) with at least one LED, and a heat sink (4) for cooling the LED, wherein the light source (2) is pivotally arranged with respect to the heat sink (4) characterised by three lever arms (6, 8, 10) that act on the light source (2), wherein the luminaire is formed in such a way that the light source (2) is pressed by means of the three lever arms (6, 8, 10) against the heat sink (4);

a spring element (12), which acts on a first lever arm (6) of the three lever arms (6, 8, 10), an adjusting means (14) to adjust a second lever arm (8) of the three lever arms (6, 8, 10), and wherein the heat sink (4) consists of two through-openings (43, 44) for the three lever arms (6, 8, 10).

* * * * *